252-95 AU 115 EX
8/18/87 XR 4,687,592

United States Patent [19]

Collins et al.

[11] Patent Number: 4,687,592

[45] Date of Patent: Aug. 18, 1987

[54] DETERGENCY BUILDER SYSTEM

[75] Inventors: Jerome H. Collins, Cincinnati; Larry N. Mackey, Fairfield; Gianfranco L. Spadini, Wyoming, all of Ohio

[73] Assignee: The Procter & Gamble Company, Cincinnati, Ohio

[21] Appl. No.: 754,561

[22] Filed: Jul. 11, 1985

Related U.S. Application Data

[63] Continuation-in-part of Ser. No. 702,521, Feb. 19, 1985, abandoned.

[51] Int. Cl.[4] ..... C11D 3/20

[52] U.S. Cl. ..... 252/99; 252/95; 252/174.16; 252/174.19; 252/174.24; 252/526; 252/527; 252/531; 252/539; 252/545; 252/546; 252/550; 252/558; 252/DIG. 2

[58] Field of Search ..... 252/95, 99, 174.16, 252/174.19, 174.24, 526, 527, 531, 539, 545, 546, 550, 558, DIG. 2

[56] References Cited

U.S. PATENT DOCUMENTS

| | | | |
|---|---|---|---|
| 3,293,176 | 12/1966 | White | 210/699 |
| 3,308,067 | 3/1967 | Diehl | 252/DIG. 2 |
| 3,368,978 | 2/1968 | Irani | 252/526 |
| 3,758,420 | 9/1973 | Connor et al. | 252/531 |
| 3,776,850 | 12/1973 | Pearson et al. | 252/174.19 |
| 4,021,376 | 5/1977 | Lamberti et al. | 252/174.19 |
| 4,083,794 | 4/1978 | Lee et al. | 252/174.24 |
| 4,125,485 | 11/1978 | Lannert | 252/174.19 |
| 4,146,495 | 3/1979 | Crutchfield et al. | 252/174.19 |

FOREIGN PATENT DOCUMENTS

| | | | |
|---|---|---|---|
| 2143231 | 2/1985 | United Kingdom | 252/95 |

*Primary Examiner*—Robert A. Wax
*Attorney, Agent, or Firm*—David K. Dabbiere; Steven J. Goldstein; Richard C. Witte

[57] ABSTRACT

A highly effective detergency builder system comprises the combination of a major proportion of an ether polycarboxylate and minor proportions of an iron and manganese chelating agent and a polymeric polycarboxylate dispersing agent.

14 Claims, No Drawings

DETERGENCY BUILDER SYSTEM

This application is a continuation-in-part of co-pending U.S. patent application Ser. No. 702,521, filed Feb. 19, 1985, now abandoned.

TECHNICAL FIELD

The present invention relates to detergency builder systems useful in detergent compositions.

BACKGROUND ART

The term detergency builder can be applied to any component of a detergent composition which increases the detergent power of a surface active agent, hereinafter surfactant. Generally recognized functions of detergency builders include removal of alkaline earth and other undesirable metal ions from washing solutions by sequestration or precipitation, providing alkalinity and buffer capacity, prevention of floculation, maintenance of ionic strength, protection of anionic surfactants from precipitation and extraction of metals from soils as an aid to their removal. Polyphosphates such as tripolyphosphates and pyrophosphates are widely used as ingredients in detergent compositions and are highly effective detergency builders. However, the effect of phosphorus on eutrophication of lakes and streams has been questioned and the use of phosphates in detergent compositions has been subject to government regulation or prohibition.

These circumstances have developed a need for highly effective and efficient phosphorus-free detergency builders. Many materials and combinations of materials have been used or proposed as detergency builders. Carbonates and silicates are widely used in granular detergent compositions, but by themselves are deficient as detergency builders in a number of respects. Aluminosilicates such as described in U.S. Pat. No. 4,274,975, issued June 23, 1981, to Corkill et al., have also been used to replace polyphosphates. Aluminosilicates, however, have relatively low calcium and magnesium binding constants and can present solubility problems, particularly in combination with silicates.

Ether polycarboxylates having one or more units of the structure

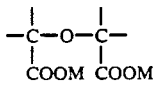

wherein M is hydrogen, an alkali metal, ammonium or substituted ammonium cation, have been proposed as detergency builder substitutes for polyphosphates. The ether polycarboxylates need not contain phosphorus or nitrogen (also subject to environmental concerns when used in large amounts) and can be more rapidly biodegradable than polymeric polycarboxylates. Ether polycarboxylates are one of the essential components of the present invention.

U.S. Pat. No. 3,293,176, issued Dec. 20, 1966, to White, discloses ether chelating compounds having carboxylic acid, phosphoric acid or sulfonic acids groups.

U.S. Pat. No. 3,692,685, issued Sept. 19, 1972 to Lamberti et al., discloses detergent compositions containing an ether polycarboxylate having the formula:

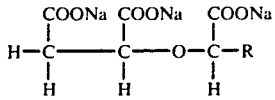

wherein R is H or $CH_2COONa$

U.S. Pat. No. 4,228,300, issued Oct. 14, 1980, to Lannert, discloses ether polycarboxylate sequestering agents and detergency builders having the formula

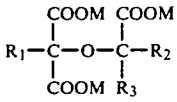

wherein M is alkali metal or ammonium, $R_1$ and $R_2$ are hydrogen, methyl or ethyl and $R_3$ is hydrogen, methyl, ethyl or COOM.

U.S. Pat. Nos. 3,923,679, issued Dec. 2, 1975, and 3,835,163, issued Sept. 10, 1974, both to Rapko, disclose 5-membered ring ether carboxylates. U.S. Pat. Nos. 4,158,635, issued June 19, 1979; 4,120,874, issued Oct. 17, 1978, and 4,102,903, issued July 25, 1978, all to Crutchfield et al. disclose 6-membered ring ether carboxylates.

U.S. Pat. No. 3,776,850, issued Dec. 4, 1973, to Pearson et al., discloses polymers to be used as detergent builders having the formula:

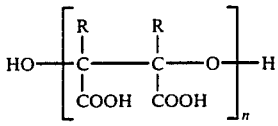

wherein R is hydrogen or other specified radicals and n is from 2 to about 40, preferably from 2 to about 6.

U.S. Pat. No. 4,146,495, issued Mar. 27, 1979, to Crutchfield et al., incorporated herein by reference, discloses a method of preparing polyacetal carboxylate detergency builders containing the structure

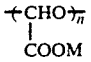

wherein M is alkali metal, ammonium, tetralkylammonium or alkanolamine and n averages at least 4.

Many, but not necessarily all, ether polycarboxylates, are deficient in calcium binding power relative to inorganic polyphosphates. This is recognized and modifications to detergent compositions have been suggested to overcome this and other deficiencies. The suggestions include an increase in surfactant level and combination with inorganic alkaline materials such as sodium silicate and sodium carbonate.

It has now been found that ether polycarboxylate materials with a calcium binding constant (expressed as log $K_{Ca}$) above a specified minimum value can be successfully incorporated in detergent compositions as part of a builder system comprising three types of organic detergency builders. The resultant detergent compositions provide, in a no or low phosphate composition, fabric cleaning in a household laundry context essentially equivalent to that provided by compositions containing from about 25% to about 50% by weight of an alkali metal polyphosphate such as sodium tripolyphosphate. The additional builders are designated iron and manganese chelating agents and polymeric polycarboxylate dispersing agents herein.

SUMMARY OF THE INVENTION

The detergent compositions of the invention contain as essential ingredients:

(a) from about 2% to about 30% by weight of a surfactant selected from the group consisting of anionic, nonionic, zwitterionic, ampholytic and cationic surfactants and mixtures thereof, (b) from about 4% to about 50% by weight of an ether polycarboxylate compound or mixtures thereof having one or more units of the structure

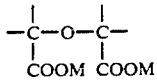

wherein M is hydrogen, an alkali metal, ammonium or substituted ammonium and said compound has a log $K_{Ca}$ (35° C., 0.1M ionic strength, pH 9.5) of at least about 3.6, (c) from about 0.1% to about 10% by weight of an iron and manganese chelating agent as hereinafter defined, (d) from about 0.5% to about 10% by weight of one or more polymeric polycarboxylic acid dispersing agents, copolymers thereof and salts thereof containing at least 60% by weight of segments having the structure:

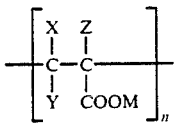

wherein X, Y and Z are each selected from the group consisting of hydrogen, methyl, carboxy, carboxymethyl, hydroxy and hydroxymethyl; and n is from about 30 to about 400, (e) from 0% to about 75%, and in a granular or tablet form composition, preferably from about 15% to about 60%, by weight of an inorganic detergency builder selected from the group consisting of alkali metal phosphates, sodium carbonate, sodium silicate, sodium aluminosilicate and mixtures thereof.

DETAILED DESCRIPTION OF THE INVENTION

The detergent compositions of the invention can be prepared in solid or liquid physical form.

The detergent compositions of the invention are particularly suitable for laundry use, but are also suitable for the cleaning of hard surfaces and for dishwashing.

In a laundry method aspect of the invention, typical laundry wash water solutions comprise from about 0.1% to about 1% by weight of the detergent compositions of the invention.

THE SURFACTANT

The compositions of the invention contain from about 2% to about 30% by weight of a surfactant or mixtures thereof.

Various types of surfactants can be used in the compositions of the invention. Useful surfactants include anionic, nonionic, ampholytic, zwitterionic and cationic surfactants or mixtures of such materials. Detergent compositions for laundry use typically contain from about 5% to about 30% anionic surfactants or mixtures of anionic and nonionic surfactants. Detergent compositions for use in automatic diswashing machines typically contain from about 2% to about 6% by weight of a relatively low sudsing nonionic surfactant or mixtures thereof and, optionally, suds control agents. Particularly suitable low sudsing nonionic surfactants are the alkylation products of compounds containing at least one reactive hydrogen wherein, preferably, at least about 20% by weight of the alkylene oxide by weight is propylene oxide. Examples are products of the BASF-Wyandotte Corporation designated Pluronic®, Tetronic®, Pluradot® and block polymeric variations in which propoxylation follows ethoxylation. Preferred suds control agents include mono-and disteryl acid phosphates.

(A)

Anionic soap and non-soap surfactants

This class of surfactants includes ordinary alkali metal monocarboxylates (soaps) such as the sodium, potassium, ammonium and alkylolammonium salts of higher fatty acids containing from about 8 to about 24 carbon atoms and preferably from about 12 to about 18 carbon atoms. Suitable fatty acids can be obtained from natural sources such as, for instance, from plant or animal esters (e.g., palm oil, coconut oil, babassu oil, soybean oil, castor oil, tallow, whale and fish oils, grease, lard, and mixtures thereof). The fatty acids also can be synthetically prepared (e.g., by the oxidation of petroleum, or by hydrogenation of carbon monoxide by the Fischer-Tropsch process). Resin acids are suitable such as rosin and those resin acids in tall oil. Naphthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids, derived from coconut oil and tallow, i.e., sodium or potassium tallow and coconut soap.

Soaps and fatty acids also act as detergency builders in detergent compositions because they remove multivalent ions by precipitation.

Anionic surfactants also includes water-soluble salts, particularly the alkali metal and ethanolamine salts of organic sulfuric reaction products having in their molecular structure an alkyl radical containing from about 8 to about 22 carbon atoms and a sulfonic acid or sulfuric acid ester radical. (Included in the term alkyl is the alkyl portion of alkylaryl radicals.) Examples of this group of non-soap anionic surfactants are the alkyl sulfates, especially those obtained by sulfating the higher alcohols ($C_8$–$C_{18}$ carbon atoms); alkyl benzene sulfonates, in which the alkyl group contains from about 9 to about 15 carbon atoms, in straight chain or branched chain configuration, sodium alkyl glyceryl ether sulfonates; fatty acid monoglyceride sulfonates and sulfates; sulfuric acid esters of the reaction product of one mole of a $C_{12-18}$ alcohol and about 1 to 6 moles of ethylene oxide; salts of alkyl phenol ethylene oxide ether sulfate with about 1 to about 10 units of ethylene oxide per molecule and in which the alkyl radicals contain about 8 to about 12 carbon atoms.

Additional examples of non-soap anionic surfactants are the reaction product of fatty acids esterified with isothionic acid and neutralized with sodium hydroxide where, for example, the fatty acids are derived from coconut oil; sodium or potassium salts of fatty acid amide of methyl lauride in which the fatty acids, for example are derived from coconut oil.

Still other anionic surfactants include the class designated as succinamates. This class includes such surface active agents as disodium N-octadecylsulfosuccinamate; tetrasodium N-(1,2-dicarboxyethyl)-N-octadecylsulfosuccinamate; the diamyl ester of sodium sulfosuccinic acid and the dihexyl ester of sodium sulfosuccinic acid; dioctyl ester of sodium sulfosuccinic acid.

Anionic phosphate surfactants are also useful in the present invention. These are surface active materials having substantial detergent capability in which the anionic solubilizing group connecting hydrophobic moieties is an oxy acid of phosphorus. The more common solubilizing groups, of course are $—SO_4H$, $—SO_3H$, and $—CO_2H$. Alkyl phosphate esters such as $(R—O)_2PO_2H$ and $ROPO_3H_2$ in which R represents an alkyl chain containing from about 8 to about 20 carbon atoms are useful.

These esters can be modified by including in the molecule from one to about 40 alkylene oxide units, e.g., ethylene oxide units.

Particularly useful anionic surfactants useful herein are alkyl ether sulfates. The alkyl ether sulfates are condensation products of ethylene oxide and monohydric alcohols having about 10 to about 20 carbon atoms. Preferably, R has 14 to 18 carbon atoms. The alcohols can be derived from fats, e.g., coconut oil or tallow, or can be synthetic. Such alcohols are reacted with 1 to 30, and especially 3 to 6, molar proportions of ethylene oxide and the resulting mixture of molecular species, having, for example, an average of 3 to 6 moles of ethylene oxide per mole of alcohol, is sulfated and neutralized.

Other suitable anionic surfactants are olefin and paraffin sulfonates having from about 12 to about 24 carbon atoms.

(B)

Nonionic surfactants

Alkoxylated nonionic surfactants may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Alkoxylated nonionic surfactants include:

(1) The condensation product of aliphatic alcohols having from 8 to 22 carbon atoms, in either straight chain or branched chain configuration, with from about 5 to about 20 moles of ethylene oxide per mole of alcohol.

(2) The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived from polymerized propylene, diisobutylene, octene, or nonene, for example.

(3) Materials derived from the condensation of ethylene oxide with a product resulting from the reaction of propylene oxide and a compound with reactive hydrogen such as glycols and amines such as, for example, compounds containing from about 40% to about 80% polyoxyethylene by weight resulting from the reaction of ethylene oxide with a hydrophobic base constituted of the reaction product of ethylene diamine and propylene oxide.

Non-polar nonionic surfactants include the amine oxides and corresponding phosphine oxides. Useful amine oxide surfactants include those having the formula $R^1R^2R^3N\rightarrow O$ wherein $R^1$ is an alkyl group containing from about 10 to about 28 carbon atoms, from 0 to about 2 hydroxy groups and from 0 to about 5 ether linkages, there being at least one moiety of $R^1$ which is an alkyl group containing from about 10 to about 18 carbon atoms and no ether linkages, and each $R^2$ and $R^3$ are selected from the group consisting of alkyl radicals and hydroxyalkyl radicals containing from 1 to about 3 carbon atoms;

Specific examples of amine oxide surfactants include: dimethyldodecylamine oxide, dimethyltetradecylamine oxide, ethylmethyltetradecylamine oxide, cetyldimethylamine oxide, diethyltetradecylamine oxide, dipropyldodecylamine oxide, bis-(2-hydroxyethyl)-dodecylamine oxide, bis-(2-hydroxypropyl)methyltetradecylamine oxide, dimethyl-(2-hydroxydodecyl)amine oxide, and the corresponding decyl, hexadecyl and octadecyl homologs of the above compounds.

(C)

Zwitterionic Surfactants

Zwitterionic surfactants include derivatives of aliphatic quaternary ammonium, phosphonium, and sulfonium compounds in which the aliphatic moiety can be straight or branched chain and wherein one of the aliphatic substituents contains from about 8 to 24 carbon atoms and one contains an anionic water-solubilizing group. Particularly preferred zwitterionic materials are the ethoxylated ammonium sulfonates and sulfates disclosed in U.S. Pat. Nos. 3,925,262, Laughlin et al, issued Dec. 9, 1975 and 3,929,678, Laughlin et al, issued Dec. 30, 1975, said patents being incorporated herein by reference.

(D)

Ampholytic Surfactants

Ampholytic surfactants include derivatives of aliphatic heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

(E)

Cationic Surfactants

Cationic surfactants comprise a wide variety of compounds characterized by one or more organic hydrophobic groups in the cation and generally by a quaternary nitrogen associated with acid radical. Pentavalent nitrogen ring compounds are also considered quaternary nitrogen compounds. Suitable anions are halides, methyl sulfate and hydroxide. Tertiary amines can have characteristics similar to cationic surfactants at washing solutions pH values less than about 8.5.

A more complete disclosure of cationic surfactants can be found in U.S. Pat. No. 4,228,044, issued Oct. 14, 1980, to Cambre, said patent being incorporated herein by reference.

When cationic surfactants are used in combination with anionic surfactants and certain detergency builders including polycarboxylates, compatibility must be considered. A type of cationic surfactant generally compatible with anionic surfactants and polycarboxylates is a $C_{8-18}$ alkyl tri $C_{1-3}$ alkyl ammonium chloride or methyl sulfate.

More complete disclosures of surfactants suitable for incorporation in detergent compositions of the invention are in U.S. Pat. Nos. 4,056,481, Tate (Nov. 1, 1977); 4,049,586, Collier (Sept. 20, 1977); 4,040,988, Vincent et al (Aug. 9, 1977); 4,035,257, Cherney (July 12, 1977); 4,033,718, Holcolm et al (July 5, 1977); 4,019,999, Ohren et al (Apr. 26, 1977); 4,019,998, Vincent et al (Apr. 26, 1977); and 3,985,669, Krummel et al (Oct. 12, 1976); all of said patents being incorporated herein by reference.

THE DETERGENCY BUILDER SYSTEM

A.

Ether Polycarboxylate

The compositions of the invention contain from about 4% to about 50%, and in solid form detergent compositions, preferably from about 15% to about 40%, of an ether polycarboxylate compound or mixtures thereof having one or more units of the general structure

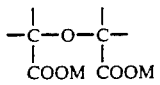

wherein M is hydrogen, an alkali metal, ammonium or substituted ammonium and said compound has a log $K_{Ca}$ (35° C., 0.1M molar strength, pH 9.5) of at least about 3.6, preferably at least about 4.2. Compounds with this structure provide calcium binding by formation of polydentate structures. Ether carboxylates with log $K_{Ca}$ values above about 5 or greater are more nearly equivalent to polyphosphates for fabric cleaning without the additional organic detergency builder components of the present invention, but nevertheless all ether polycarboxylates tend to be somewhat deficient when used as a direct replacement for polyphosphates on a mole equivalent basis.

Ether polycarboxylates having the structure:

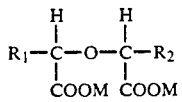

wherein $R_1$ and $R_2$ are each H, COOM or $CH_2COOM$ and M is H, alkali metal, ammonium or substituted ammonium constitute embodiments of the invention particularly benefited by the combination with iron and manganese chelating agents and polymeric polycarboxylate dispersing agents.

Specific ether polycarboxylates particularly benefited include 2-oxa-1,1,3-propanetricarboxylates, 2-oxa-1,3,4-butanetricarboxylates, 3-oxa-1,2,4,5-pentanetetracarboxylates and polyacetal carboxylates having the structure

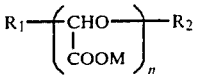

wherein M is hydrogen or a monovalent cation, n averages at least 4, preferably at least about 50, and $R_1$ and $R_2$ are groups to stabilize against rapid depolymerization in alkaline solution such as disclosed in U.S. Pat. No. 4,144,226 issued Mar. 13, 1979, to Crutchfield et al, incorporated herein by reference.

A method for the preparation of 2-oxa-1,1,3-propanetricarboxylic acid is disclosed in U.S. Pat. No. 4,228,300, issued Oct. 14, 1980, to Lannert, incorporated herein by reference.

A method for the preparation of 2-oxa-1,3,4-butanetricarboxylic acid is disclosed in U.S. Pat. No. 3,692,685, issued Sept. 19, 1972, to Lamberti et al, incorporated herein by reference.

A method for the preparation of 3-oxa-1,2,4,5-pentanetetracarboxylic acid is disclosed in U.S. Pat. No. 3,128,287 issued Apr. 7, 1964, to Berg, incorporated herein by reference.

Crutchfield, M. M., J. Am. Oil Chemists' Soc. 55:58 (1978), incorporated herein by reference, lists log $K_{Ca}$ values of a large number of ether polycarboxylates suitable for use in detergent compositions of the present invention.

Also suitable in the compositions of the invention are the 3,3-dicarboxy-4-oxa-1,6-hexanedioates and the related compounds disclosed in U.S. Ser. No. 672,302 filed Nov. 16, 1984, and incorporated herein by reference.

Suitable ether polycarboxylates include cyclic compounds, particularly alicyclic compounds, provided they have the essential substructure described hereinbefore. U.S. Pat. Nos. 3,923,679; 3,835,163; 4,158,635; 4,120,874 and 4,102,903 discussed hereinbefore, incorporated herein by reference, disclose such cyclic ether polycarboxylates.

CALCIUM BINDING CONSTANT DETERMINATION

A computer system (Hewlett-Packard) with digital voltmeters was used to collect and analyze data from an Orion calcium selective electrode and a linear syringe buret (Sage Instruments syringe pump plus a linear potentiometer). An Analog Devices 40J non-inverting operational amplifier electrometer amplified the calcium electrode voltage and provided Nernstian behavior of the electrode into the $10^{-7}$M range. Volumetric accuracy was better than +/−0.5%.

Three hundred data pairs of [Ca total] vs $10^{(E/S)}$, which is a linear measure of [Ca free], were collected and corrected for dilution during each titration. S is the Nernst equation slope, ca. 29 mv/decade, and E is the calcium electrode voltage. Calcium ion was titrated into buffer solution. Here, L represents the sequestering ligand. A ligand-free standard titration calibrated the electrode response. A second titration, containing a fixed concentration of total ligand [L tot] allowed calculation of $K_{Ca}$ at various [Ca tot]/[L tot] ratios. A third titration, adding Ca ion to a solution of a fixed [L tot] and fixed [Mg tot] was compared with $K_{Ca}$ at different [Ca tot]/[L tot] ratios to reveal $K_{Mg}$ at those same ratios.

$$\text{Run 2: } K_{Ca} = \frac{[\text{Ca tot}] - [\text{Ca free}]}{[\text{Ca free}] \times [L\ \text{free}]}$$

$$\text{where } [L\ \text{free}] = [L\ \text{tot}] - [\text{Ca tot}] + [\text{Ca free}]$$

$$\text{Run 3: } K_{Mg} \text{ in presence of Ca} = \frac{[\text{Mg } L]}{[\text{Mg free}] \times [L\ \text{free}]}$$

where $$[\text{Mg } L] = [L\ \text{tot}] - [\text{Ca } L] - [L\ \text{free}]$$

$$[\text{Mg free}] = [\text{Mg tot}] - [\text{Mg } L]$$

$$[L\ \text{free}] = \frac{[\text{Ca } L]}{[\text{Ca free}] \times K_{Ca}}$$

and $$[\text{Ca } L] = [\text{Ca tot}] - [\text{Ca free}]$$

At high ratios of [Ca tot]/[L tot], the ligand became saturated with Ca ion and a linear increase in [Ca free] resulted. This line was extrapolated back to [Ca free]=0 and [Ca tot] at that point represented a measure of calcium binding capacity.

pH was always 9.55, temperature 22° C. Ionic strength ca. 0.1M, [Ca tot]=0 to 1.4 mM (0 to 8.2 gr/gal), [Ligand total]=$3.52\times10^{-4}$M, [Mg total]=2.0 mM.

Calcium Ion Binding Constants
(35° C., 0.1 M ionic strength, pH 9.5)

| | Log $K_{Ca}$ |
|---|---|
| Sodium tripolyphosphate | 4.9 |
| Nitrilotriacetic acid, sodium salt | 5.5 |
| 2-oxa-1,1,3 propanetricarboxylic acid, sodium salt | 4.3 |
| 2-oxa-1,3,4 butanetricarboxylic acid, sodium salt | 3.7 |
| 3-oxa-1,2,4,5-pentanetetracarboxylic acid sodium salt | 4.7 |
| Sodium citrate | 3.5 |

IRON AND MANGANESE CHELATING AGENT

The detergent compositions of the invention contain from about 0.1% to about 10%, preferably from about 0.5% to about 10%, more preferably from about 0.75% to about 6% and most preferably from about 0.75% to about 3%, by weight of an iron and manganese chelating agent or mixtures thereof. Preferably the weight ratio of ether polycarboxylate to chelating agent is from about 3:1 to about 40:1, more preferably from about 10:1 to about 30:1 and most preferably from about 15:1 to about 30:1.

The iron and manganese chelating agents of the invention are selected from the group consisting of amino carboxylates, amino phosphonates, polyfunctionally—substituted aromatic chelating agents and mixtures thereof, all as hereinafter defined.

Without relying on theory, it is speculated that the benefit of these materials is due in part to an exceptional ability to remove iron and manganese ions from washing solutions by formation of soluble chelates.

Amino carboxylates useful in compositions of the invention have one or more, preferably at least two, units, of the substructure

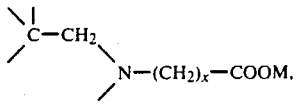

wherein M is hydrogen, alkali metal, ammonium or substituted ammonium (e.g. ethanolamine) and x is from 1 to about 3, preferably 1. Preferably, said amino carboxylates do not contain alkyl or alkenyl groups with more than about 6 carbon atoms. Alkylene groups can be shared by substructures.

Included are ethylenediaminetetraacetates, N-hydroxyethylethylenediaminetriacetates, nitrilotriacetates, ethylenediamine tetrapropionates, diethylenetriaminepentaacetates, and ethanoldiglycines.

Amino phosphonates are suitable in the compositions of the invention when at least low levels of total phosphorus are permitted in detergent compositions. Compounds with one or more, preferably at least two, units of the substructure

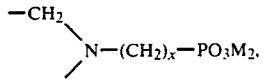

wherein M is hydrogen, alkali metal, ammonium or substituted ammonium and x is from 1 to about 3, preferably 1, are useful and include ethylenediaminetetrakis(methylenephosphonates), nitrilotris(methylenephosphonates) and diethylenetriaminepentakis(methylenephosphonates). Preferably, said amino phosphonates do not contain alkyl or alkenyl groups with more than about 6 carbon atoms. Alkylene groups can be shared by substructures.

Polyfunctionally—substituted aromatic chelating agents of the invention comprise compounds having the general formula

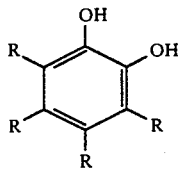

wherein at least one R is —$SO_3H$ or —COOH or soluble salts thereof and mixtures thereof.

U.S. Pat. No. 3,812,044 issued May 21, 1974, to Connor et al, incorporated herein by reference, discloses polyfunctionally—substituted aromatic chelating and sequestering agents.

Preferred compounds in acid form are dihydroxydisulfobenzenes and 1,2-dihydroxy-3,5-disulfobenzene or other disulfonated catechols in particular. Alkaline detergent compositions can contain these materials in the form of alkali metal, ammonium or substituted ammonium (e.g. mono- or triethanolamine) salts.

POLYMERIC POLYCARBOXYLATE DISPERSING AGENT

The detergent compositions of the invention contain from about 0.5% to about 10%, preferably from about 0.75% to about 6%, and most preferably from about 0.75% to about 3% by weight of one or more polymeric polycarboxylate dispersing agents, copolymers thereof and salts thereof containing at least about 60% by weight of segments with the general formula

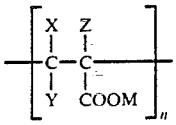

wherein X, Y, and Z are each selected from the group consisting of hydrogen, methyl, carboxy, carboxymethyl, hydroxy and hydroxymethyl; M is hydrogen, alkali metal, ammonium or substituted ammonium and n is from about 30 to about 400. Preferably, X is hydrogen or hydroxy, Y is hydrogen or carboxy and Z is hydrogen.

The polymeric polycarboxylates of greatest value in compositions of the invention are those that provide a dispersant effect for particulate soil or other insoluble material in the washing solution. This chacteristic is related to, but not identical with, precipitation modification as disclosed in U.S. Pat. No. 3,896,056 issued July 22, 1975, to Benjamin et al, incorporated herein by reference.

Preferably, the weight ratio of polymeric polycarboxylate dispersing agent to iron and manganese chelating agent is in the range of from about 3:1 to about 1:3, most preferably from about 2:1 to about 1:2. Suitable polymeric polycarboxylates generally include those disclosed in U.S. Pat. No. 3,308,067 issued Mar. 7, 1967, to Diehl, incorporated herein by reference. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable provided that such segments do not constitute more than about 40% by weight.

Particularly suitable polymeric polycarboxylates are polyacrylates with an average molecular weight in acid form of from about 1,000 to about 10,000, and acrylate/maleate or acrylate/fumarate copolymers with an average molecular weight of from about 2,000 to about 20,000 and a ratio of acrylate to maleate or fumarate segments of from about 30:1 to about 2:1. This and other suitable copolymers based on a mixture of unsaturated mono- and dicarboxylate monomers are disclosed in European Patent Applicant No. 66,915, published Dec. 15, 1982, incorporated herein by reference.

Although the polymeric polycarboxylates contribute to the alkaline earth metal ion sequestration provided by the ether polycarboxylate component, the optimum molecular weight for dispersing of particulate material in the washing solution is generally lower than the molecular weight optimum for multivalent metal ion sequestration.

OPTIONAL DETERGENCY BUILDERS

The detergent compositions of the present invention can contain detergency builders in addition to the essential combination described herein.

Suitable additional polycarboxylate detergency builders include the acid form and alkali metal, ammonium and substituted ammonium salts of citric, ascorbic, phytic, mellitic, benzene pentacarboxylic, cyclohexanehexacarboxylic and cyclopentanetetracarboxylic acids.

Non-amino polyphosphonate detergency builders comprise organic compounds having two or more

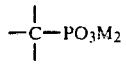

groups wherein M is hydrogen, alkali metal, ammonium or substituted ammonium. Suitable phosphonates include ethane-1-hydroxy-1,1-diphosphonates, ethanehydroxy-1,1,2-triphosphonates and their oligomeric ester chain condensates. In common with other phosphorus-containing components, the incorporation of phosphonates may be restricted or prohibited by government regulation.

As discussed hereinbefore $C_{8-24}$ alkyl monocarboxylic acid and soluble salts thereof have a detergent builder function in addition to surfactant characteristics. $C_{10}$–$C_{20}$ alkyl, alkenyl, alkoxy and alkyl thio-substituted dicarboxylic acid compounds, such as 4-pentadecene-1,2-dicarboxylic acid, salts thereof and mixtures thereof, are also useful optional detergency builders.

Inorganic detergency builders useful in the compositions of the invention at total combined levels of from 0% to about 75% by weight, include alkali metal phosphates, sodium aluminosilicates, alkali metal silicates and alkali metal carbonates.

Granular laundry detergent compositions generally contain at least about 40% of inorganic salts and it is desirable that a major portion of such salts have a contribution to the detergent effect. Inorganic detergency builders are less useful in liquid detergent compositions of the invention and can be omitted to provide optimum physical properties and optimum levels of the essential components.

Phosphate detergency builders include alkali metal orthophosphates which remove multivalent metal cations from laundry solutions by precipitation and the polyphosphates such as pyrophosphates, tripolyphosphates and water-soluble metaphosphates that sequester multivalent metal cations in the form of soluble complex salts. Sodium pyrophosphate and sodium tripolyphosphate are particularly suitable in granular detergent compositions and potassium pyrophosphate is suitable in liquid detergent compositions to the extent that governmental regulations do not restrict or prohibit the use of phosphorus-containing compounds in detergent compositions. Granular detergent composition embodiments of the invention particularly adapted for use in areas where the incorporation of phosphorus-containing compounds is restricted contains low total phosphorus and, preferably, essentially no phosphorus.

Crystalline aluminosilicate ion exchange materials useful in the practice of this invention have the formula $Na_z[(AlO_2)_z.(SiO_2)y]xH_2O$ wherein z and y are at least about 6, the molar ratio of z to y is from about 1.0 to about 0.5 and x is from about 10 to about 264. In a preferred embodiment the aluminosilicate ion exchange material has the formula $Na_{12}[(AlO_2)_{12}(SiO_2)_{12}]xH_2O$ wherein x is from about 20 to about 30, especially about 27.

Amorphous hydrated aluminosilicate material useful herein has the empirical formula: $Na_2(zAlO_2.ySiO_2)$, z is from about 0.5 to about 2, y is 1 and said material has a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCo_3$ water hardness/gm. of aluminosilicate, calculated on an anhydrous basis, and which generally is in the range of from about 300 mg.eq./g. to about 352 mg. eq./g. The aluminosilicate ion exchange materials herein are still further characterized by their calcium ion exchange rate which is at least about 2 grains Ca.++/gallon/minute/gram of aluminosilicate (anhydrous basis), and generally lies within the range of from about 2 grains/gallons/minute/gram to about 6 grains/gallons/minute/gram, based on calcium ion hardness. Optimum aluminosilicate for builder purposes exhibit a calcium ion exchange rate of at least about 4 grains/gallons/minute/gram.

The amorphous aluminosilicate ion exchange materials usually have a Mg++ exchange capacity of at least about 50 mg. eq. $CaCO_3$/g (12 mg. Mg++/g.) and a Mg++ exchange rate of at least about 1 gr./gal./min./g./gal. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, issued Oct. 12, 1976, incorporated herein by reference. Preferred synthetic crystalline aluminosilicate ion exchange materials useful herein are available under the designation Zeolite A, Zeolite B, and Zeolite X.

Suitable alkali metal silicates have a mole ratio of $SiO_2$: alkali metal oxide in the range of from about 1:1 to about 4:1. The alkali metal silicate suitable herein include commercial preparations of the combination of silicon dioxide and alkali metal oxide or carbonate fused together in varying proportions according to, for example, the following reaction:

$$mSiO_2 + Na_2CO_3 \xrightarrow{2600^\circ F.} mSiO_2{:}Na_2O + CO_2$$

The value of m, designating the molar ratio of $SiO_2$:$Na_2O$, ranges from about 0.5 to about 4 depending on the proposed use of the sodium silicate. The term "alkali metal silicate" as used herein refers to silicate solids with any ratio of $SiO_2$ to alkali metal oxide. Silicate solids normally possess a high alkalinity content; in addition water of hydration is frequently present as, for example, in metasilicates which can exist having 5, 6, or 9 molecules of water. Sodium silicate solids with a $SiO_2$:$Na_2O$ mole ratio of from about 1.5 to about 3.5, are preferred in granular laundry detergent compositions.

Silicate solids are frequently added to granular detergent compositions as corrosion inhibitors to provide protection to the metal parts of the washing machine in which the detergent composition is utilized. Silicates have also been used to provide a degree of crispness and pourability to detergent granules which is very desirable to avoid lumping and caking.

Alkali metal carbonates are useful in the granular compositions of the invention as a source of washing solution alkalinity and because of the ability of the carbonate ion to remove calcium and magnesium ions from washing solutions by precipitation.

Preferred granular compositions free of inorganic phosphates contain from about 10% to about 40% by weight sodium carbonate, from 0% to about 30% sodium aluminosilicate, from about 0.5% to about 10% sodium silicate solids, from about 10% to about 35% of the ether carboxylates of the invention and from about 10% to about 25% surfactant.

Preferred liquid compositions free of inorganic phosphates contain from about 8% to about 20% by weight of non-soap anionic surfactants, from about 2% to about 18% ethoxylated nonionic surfactants, from about 5% to about 20% of a $C_{10-22}$ alkyl or alkenyl mono-or dicarboxylic acid or salt thereof and from about 5% to about 15% of the ether carboxylates of the invention.

ADDITIONAL OPTIONAL COMPONENTS

Granular compositions of this invention can contain materials such as sulfates, borates, perborates and water of hydration.

Liquid compositions of this invention can contain water and other solvents. Low molecular weight primary or secondary alcohol exemplified by methanol, ethanol, propanol, and isopropanol are suitable. Monohydric alcohols are preferred for solubilizing the surfactant but polyols containing from 2 to about 6 carbon atoms and from 2 to about 6 hydroxy groups can be used and can provide improved enzyme stability. Examples of polyols include propylene glycol, ethylene glycol, glycerine and 1,2-propanediol. Ethanol is a particularly preferred alcohol.

The compositions of the invention can contain such materials as proteolytic and amylolytic enzymes, fabric whiteners and brighteners, sudsing control agents, hydrotropes such as sodium toluene or xylene sulfonate, perfumes, colorants, opacifiers, anti-redeposition agents and alkalinity control or buffering agents such as monoethanolamine and triethanolamine. The use of these materials is known in the detergent art.

Materials that provide clay soil removal/anti-redeposition benefits can also be incorporated in the detergent compositions of the invention and are particularly useful in liquid compositions of the invention.

These clay soil removal/anti-redeposition agents are usually included at levels of from about 0.1% to about 10% by weight of the composition.

One group of preferred clay soil removal/anti-redeposition agents are the ethoxylated amines disclosed in European Patent Application No. 112,593 of James M. Vander Meer, published July 4, 1984, incorporated herein by reference. Another group of preferred clay soil removal/anti-redeposition agents are the cationic compounds disclosed in European patent application No. 111,965 to Young S. Oh and Eugene P. Gosselink, published June 27, 1984, incorporated herein by reference. Other clay soil removal/anti-redeposition agents which can be used include the ethoxylated amine polymers disclosed in European patent application No. 111,984 to Eugene P. Gosselink, published June 27, 1984; the zwitterionic compounds disclosed in European patent application No. 111,976 to Donn N. Rubingh and Eugene P. Gosselink, published June 27, 1984; the zwitterionic polymers disclosed in European patent application No. 112,592 to Eugene P. Gosselink, published July 4, 1984; and the amine oxides disclosed in U.S. application Ser. No. 516,612 to Daniel S. Connor, filed July 22, 1983, all of which are incorporated herein by reference. Polyethylene glycol can also be incorporated to prvide anti-redeposition and other benefits.

Soil release agents, such as disclosed in the art to reduce oily staining of polyester fabrics, are also useful in the compositions of the invention. U.S. Pat. No. 3,962,152 issued June 8, 1976, to Nicol et al., incorporated herein by reference, discloses copolymers of ethylene terephthalate and polyethylene oxide terephthalate as soil release agents. U.S. Pat. No. 4,174,305 issued Nov. 13, 1979, to Burns et al., incorporated herein by reference, discloses cellulose ether soil release agents.

The detergent compositions of the invention can also include a bleach system comprising an inorganic or organic peroxy bleaching agent and, in preferred compositions, an organic peroxy acid bleach precursor.

Suitable inorganic peroxygen bleaches include sodium perborate mono- and tetrahydrate, sodium percarbonate, sodium persilicate and urea-hydrogen peroxide addition products and the clathrate $4Na_2SO_4{:}2H_2O_2{:}1NaCl$. Suitable organic bleaches include peroxylauric acid, peroxyoctanoic acid, peroxynonanoic acid, peroxydecanoic acid, diperoxydodecandioic acid, diperoxyazelaic acid, mono- and diperoxyphthalic acid and mono- and diperoxyisophthalic acid. The bleaching agent is generally present in the compositions of the invention at a level of from about 5% to about 35% preferably from about 10% to about 25% by weight.

The compositions of the invention preferably also contain an organic peroxy acid bleach precursor at a level of from about 0.5% to about 10%, preferably from about 1% to about 6% by weight. Suitable bleach precursors are disclosed in No. UK-A-2040983, and include for example, the peracetic acid bleach precursors such as tetraacetylethylenediamine, tetraacetylmethylenediamine, tetraacetylhexylenediamine, sodium p-acetoxybenzene sulfonate, tetraacetylglycouril, pentaacetylglucose, octaacetyllactose, and methyl o-acetoxy benzoate. Highly preferred bleach precursors, however, have the general formula

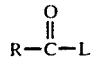

wherein R is an alkyl group containg from 6 to 12 carbon atoms wherein the longest linear alkyl chain extending from and including the carboxyl carbon contains from 5 to 10 carbon atoms and L is a leaving group, the conjugate acid of which has a logarithmic acidity constant in the range from 6 to 13.

The alkyl group, R, can be either linear or branched and, in preferred embodiments, it contains from 7 to 9 carbon atoms. Preferred leaving groups L have a logarithmic acidity constant in the range from about 7 to about 11, more preferably from about 8 to about 10. Examples of leaving groups are those having the formula

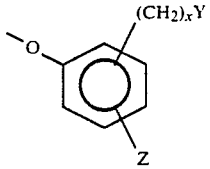

(a)

and

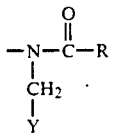

(b)

wherein Z is H, $R^1$ or halogen, $R^1$ is an alkyl group having from 1 to 4 carbon atoms, X is 0 or an integer of from 1 to 4 and Y is selected from $SO_3M$, $OSO_3M$, $CO_2M$, $N^+(R^1)_3O^-$ and $N^+(R^1)_2—O^-$ wherein M is H, alkali metal, alkaline earth metal, ammonium or substituted ammonium, and O is halide or methosulfate.

The preferred leaving group L has the formula (a) in which Z is H, x is 0 and Y is sulfonate; carboxylate or dimethylamine oxide radical. Highly preferred materials are sodium 3,5,5,-trimethylhexanoyloxybenzene sulfonate, sodium 3,5,5-trimethylhexanoyloxybenzoate, sodium 2-ethylhexanoyl oxybenzenesulfonate, sodium nonanoyl oxybenzene sulfonate and sodium octanoyl oxybenzenesulfonate, the acyloxy group in each instance preferably being p-substituted.

The bleach activator herein will normally be added in the form of particles comprising finely-divided bleach activator and a binder. The binder is generally selected from nonionic surfactants such as the ethoxylated tallow alcohols, polyethylene glycols, anionic surfactants, film forming polymers, fatty acids and mixtures thereof. Highly preferred are nonionic surfactant binders, the bleach activator being admixed with the binder and extruded in the form of elongated particles through a radial extruder as described in European Patent Application No. 62523. Alternatively, the bleach activator particles can be prepared by spray drying.

EXAMPLES

The following embodiments illustrate, but are not limiting of, detergent compositions of the present invention. All percentages herein are by weight unless indicated otherwise.

EXAMPLE I

A granular detergent composition for household laundry use is as follows:

| Component | Wt. % |
|---|---|
| Sodium $C_{14}$–$C_{15}$ alkylsulfate | 13.3 |
| Sodium $C_{13}$ linear alkyl benzene sulfonate | 5.7 |
| $C_{12}$–$C_{13}$ alkylpolyethoxylate (2.5) | 1.0 |
| Sodium toluene sulfonate | 1.0 |
| 3-oxa-1,2,4,5-pentanetetracarboxylic acid, sodium salt | 25.0 |
| Sodium N—hydroxyethyethylenediamine-triacetate | 2.0 |
| Sodium polyacrylate (Avg. M.W. = ±5000) | 2.0 |
| Sodium carbonate | 20.3 |
| Sodium silicate | 5.8 |
| Polyethylene glycol (Avg. M.W. ±8000) | 1.0 |
| Sodium sulfate, water and miscellaneous | Balance to 100 |

In the composition of Example I the following substitutions are made:

(a) for 3-oxa 1,2,4,5-pentanetetracarboxylic acid, sodium salt
  (1) 2-oxa-1,1,3-propanetricarboxylic acid, sodium salt
  (2) 2-oxa-1,3,4-butanetricarboxylic acid, sodium salt
  (3) a polyacetal carboxylate with the approximate formula

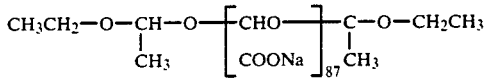

(b) for N-hydroxyethylethylenediaminetriacetate, sodium salt
  (1) diethylenetriaminepentakis(methylenephosphonate), sodium salt
  (2) 1,2-dihydroxy-3,5-disulfobenzene, sodium salt (c) for sodium polyacrylate (avg. M.W.=±5000)
  (1) sodium salt of an acrylate/maleate copolymer (avg. M.W.=9000) in which the acrylate/maleate weight ratio is approximately 7:3.

The components are added together with continuous mixing with sufficient extra water (about 40% total) to form an aqueous slurry which is then spray dried to form the composition.

EXAMPLE II

A liquid detergent composition for household laundry use is as follows:

| Component | Wt. % |
|---|---|
| Potassium $C_{14}$–$C_{15}$ alkyl polyethoxy (2.5) sulfate | 8.3 |
| $C_{12}$–$C_{14}$ alkyl dimethyl amine oxide | 3.3 |
| Potassium toluene sulfonate | 5.0 |
| Monoethanolamine | 2.3 |
| 2-oxa-1,1,3-propanetricarboxylic acid, potassium salt | 15.0 |
| Sodium salt of 1,2-dihydroxy-3,5-disulfobenzene | 1.5 |
| Sodium polyacrylate (avg. M.W. = ±9000) | 1.5 |
| Minors and water | Balance to 100 |

The components are added together with continuous mixing to form the composition.

EXAMPLE III

A liquid detergent composition for household laundry use is prepared by mixing the following ingredients:

| | |
|---|---|
| $C_{13}$ alkylbenzenesulfonic acid | 10.5% |
| Triethanolamine cocoalkyl sulfate | 4.0 |
| $C_{14-15}$ alcohol ethoxy-7 | 12.0 |
| $C_{12-18}$ alkyl monocarboxylic acids | 15.0 |
| 3-oxa-1,2,4,5-pentanetetracarboxylic acid | 5.0 |
| Diethylenetriaminepentamethylene phosphonic acid | 0.8 |
| Polyacrylic acid (avg. M.W. = ±5000) | 0.8 |
| Triethanolamine | 4.5 |
| Ethanol | 8.6 |
| 1,2-Propanediol | 3.0 |
| Water, perfume, buffers and miscellaneous | Balance to 100 |

3,3-dicarboxy-4-oxa-1,6-hexanedioic acid is substituted for 3-oxa-1,2,4,5-pentanetetracarboxylic acid.

The acrylate/maleate copolymer of Example I in acid form is substituted for polyacrylic acid.

N-hydroxyethylethylenediaminetriacetic acid is substituted for diethylenetriaminepentakis(methylenephosphonic) acid.

EXAMPLE IV

In the Compositions which follow, the abbreviations used have the following designations:

$C_{12}$LAS: Sodium linear $C_{12}$ benzene sulfonate

TAS: Sodium tallow alcohol sulfonate

TAE$_n$: Hardened tallow alcohol ethoxylated with n moles of ethylene oxide per mole of alcohol Dobanol $45_E7$: A $C_{14-15}$ primary alcohol condensed with 7 moles of ethylene oxide TAED: Tetraacetyl ethylene diamine NOBS: Sodium nonanoyl oxybenzenesulfonate INOBS: Sodium 3,5,5 trimethyl hexanoyl oxybenzene sulfonate Silicate: Sodium silicate having an $SiO_2$:$Na_2O$ ratio of 1:6

Sulfate: Anhydrous sodium sulfate

Carbonate: Anhydrous sodium carbonate

CMC: Sodium carboxymethyl cellulose

Silicone: Comprising 0.14 parts by weight of an 85:15 by weight mixture of silanated silica and silicone, granulated with 1.3 parts of sodium tripolyphosphate, and 0.56 parts of tallow alcohol condensed with 25 molar proportions of ethylene oxide PC1: Copolymer of 3:7 maleic/acrylic acid, average molecular weight about 70,000, as sodium salt PC2: Polyacrylic acid, average molecular weight about 4,500, as sodium salt PESA: Polyepoxysuccinic acid of formula HO—[CH(COOH)—CH(COOH)—O]$_n$—H n averaging about 10 (contains at least about 25% by weight where n=2–4), M.W. (as Na salt, by NMR)=950, Log $K_{Ca}$=5.3

Perborate: Sodium perborate tetrahydrate of nominal formula $NaBO_2.3H_2O.H_2O_2$ Enzyme: Protease EDTA: Sodium ethylene diamine tetra acetate Brightener: Disodium 4,4'-bis(2-morpholino-4-anilino-s-triazin-6-ylamino)stilbene-2:2'disulfonate DETPMP: Diethylene triamine penta(methylene phosphonic acid), marketed by Monsanto under the Trade name Dequest 2060

EDTMP: Ethylenediamine tetra(methylene phosphonic acid), marketed by Monsanto, under the Trade name Dequest 2041

Granular detergent compositions are prepared as follows. A base powder composition is first prepared by mixing all components except, where present, Dobanol 45E7, bleach, bleach activator, enzyme, suds suppressor, phosphate and carbonate in crutcher as an aqueous slurry at a temperature of about 55° C. and containing about 35% water. The slurry is then spray dried at a gas inlet temperature of about 330° C. to form base powder granules. The bleach activator, where present, is then admixed with $TAE_{25}$ as binder and extruded in the form of elongated particles through a radical extruder as described in European Patent Application No. 62523. The bleach activator noodles, bleach, enzyme, suds suppressor, phosphate and carbonate are then dry-mixed with the base powder composition and finally Dobanol 45E7 is sprayed into the final mixture.

| | COMPOSITIONS | | | |
|---|---|---|---|---|
| | A | B | C | D |
| $C_{12}LAS$ | 4 | 9 | 8 | 8 |
| TAS | 4 | 3 | — | 3 |
| $TAE_{25}$ | 0.5 | 0.5 | 0.8 | — |
| $TAE_{11}$ | — | 1 | — | — |
| Dobanol 45E7 | 4 | — | 4 | 2 |
| NOBS | — | 2 | — | — |
| INOBS | 3 | — | — | — |
| TAED | 0.5 | — | 3 | — |
| Perborate | 19 | 20 | 10 | 24 |
| EDTMP | 0.3 | — | 0.4 | 0.1 |
| DETPMP | — | 0.4 | — | — |
| EDTA | 0.2 | 0.2 | 0.2 | 0.1 |
| Magnesium (ppm) | 1000 | 1000 | 750 | — |
| PC1 | 2 | 1 | 2 | 2 |
| PC2 | 1 | 1 | — | 1 |
| PESA | 25 | 7 | 15 | 10 |
| Zeolite A* | — | 15 | 14 | — |
| Sodium tripolyphosphate | — | — | — | 12 |
| Coconut Soap | — | — | — | 2 |
| Carbonate | 17 | 15 | 10 | — |
| Silicate | 3 | 2 | 2 | 7 |
| Silicone | 0.2 | 0.2 | 0.3 | 0.2 |
| Enzyme | 0.8 | 0.5 | 0.4 | 0.3 |
| Brightener | 0.2 | 0.2 | 0.2 | 0.2 |
| Sulfate, Moisture & Miscellaneous | | | to 100 | |

*Zeolite A of 4 A pore size.

The above compositions are zero and low phosphate detergent compositions displaying excellent bleach stability, fabric care and detergency performance across the range of wash temperatures with particularly outstanding performance in the case of Compositions A, B and C on greasy and particulate soils at low wash temperatures.

What is claimed is:

1. A detergent composition comprising:

(a) from about 2% to about 30% by weight of a surfactant selected from the group consisting of anionic, nonionic, zwitterionic, ampholytic and cationic surfactants and mixtures thereof;

(b) from about 15% to about 40% of an ether polycarboxylate compound or mixtures thereof of the structure:

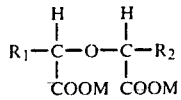

wherein $R_1$ and $R_2$ are each independently H, COOM or $CH_2COOM$ and wherein $R_1$ and $R_2$ are not both H and wherein M is hydrogen, an alkali metal, ammonium or substituted ammonium and said compound has a log $K_{Ca}$ (35° C., 0.1M ionic strength, pH 9.5) of at least about 3.6;

(c) from about 0.75% to about 3% by weight of an iron and manganese chelating agent selected from the group consisting of: 1) amino carboxylates having one or more units of the substructure:

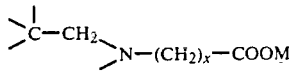

wherein M is hydrogen, an alkali metal, ammonium or substituted ammonium, and x is from 1 to about 3, (2) amino phosphonates having one or more units of the substructure:

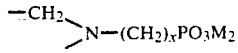

wherein M is hydrogen, an alkali metal, ammonium or substituted ammonium and x is from 1 to about 3, 3) polyfunctionally-substituted aromatic chelating agents consisting of compounds having the formula:

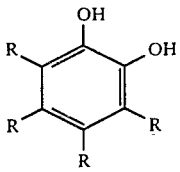

wherein at least one R is —$SO_3H$, or —COOH or soluble salts thereof and mixtures thereof and 4) mixtures thereof;

(d) from about 0.75% to about 3% by weight of one or more polymeric polycarboxylic acid dispersing agents, copolymers thereof and salts thereof containing at least about 60% by weight of segments with the general formula:

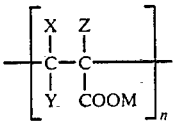

wherein X, Y and Z are each selected from the group consisting of hydrogen, methyl, and carboxy; M is hydrogen, alkali metal, ammonium or substituted ammonium and n is from about 30 to about 400; and (e) from 0% to about 75% by weight of an inorganic detergency builder selected from the group consisting of alkali metal phosphates, sodium carbonate, sodium silicate, sodium aluminosilicate and mixtures thereof.

2. The composition of claim 1 wherein the ether polycarboxylate has a log $K_{Ca}$ of at least about 4.2.

3. The composition of claim 1 wherein the ether polycarboxylate comprises a material selected from the group consisting of 2-oxa-1,1,3 propanetricarboxylic acid, 2-oxa-1,3,4 butanetricarboxylic acid, 3-oxa-1,2,4,5-pentanetetracarboxylic acid, mixtures thereof and alkali metal, ammonium and substituted ammonium salts thereof.

4. The composition of claim 1 wherein the iron and manganese chelating agent comprises a material selected from the group consisting of ethylenediaminetetraacetates, diethylenetriaminepentaacetates, N-hydroxyethylethylenediaminetriacetates, nitrilotriacetates, ethanoldiglycines, ethylenediaminetetrakis(methylenephosphonates), nitrilotris(methylenephosphonates), diethylenetriaminepentakis(methylenephosphonates), disulfonated catechols, mixtures thereof and alkali metal, ammonium and substituted ammonium salts thereof.

5. The composition of claim 3 wherein the polymeric polycarboxylate comprises a material selected from the group consisting of polyacrylates, copolymers of acrylates and maleates, mixtures thereof and alkali metal, ammonium and substituted ammonium salts thereof.

6. The composition of claim 1 wherein said composition is a granular detergent composition comprising from about 15% to about 60% of an inorganic detergency builder selected from the group consisting of sodium carbonate, sodium silicate and mixtures thereof and from about 15% to about 40% of sodium salts of said ether polycarboxylate compound or mixtures thereof.

7. The composition of claim 5 wherein said surfactant comprises an anionic surfactant selected from the group consisting of alkyl sulfates, alkyl ether sulfates, alkylbenzene sulfonates and mixtures thereof.

8. The composition of claim 6 wherein said ether polycarboxylate comprises a material selected from the group consisting of the sodium salts of 2-oxa-1,1,3-propanetricarboxylic acid, 2-oxa-1,3,4-butanetricarboxylic acid, 3-oxa-1,2,4,5-pentanetetracarboxylic acid, and mixtures thereof.

9. The composition of claim 7 containing essentially no phosphorus.

10. The composition of claim 8 which comprises an alkali metal salt of a polymeric polycarboxylate selected from the group consisting of polyacrylates, copolymers of acrylates and maleates and mixtures thereof.

11. The composition of claim 1 wherein said composition is a liquid detergent composition comprising from about 5% to about 15% of said ether polycarboxylate or mixture thereof.

12. A composition according to claim 1 additionally comprising from about 5% to about 35% by weight of inorganic or organic peroxy bleaching agent.

13. A composition according to claim 11 additionally comprising from about 0.5% to about 10% by weight of organic peroxyacid bleach precursor.

14. A composition according to claim 12 wherein the bleach precursor has the general formula:

$$R-\overset{\overset{\displaystyle O}{\|}}{C}-L$$

wherein R is an alkyl group containing from 6 to 12 carbon atoms wherein the longest linear alkyl chain extending from and including the carboxyl carbon contains from 5 to 10 carbon atoms and L is a leaving group, the conjugate acid of which has a logarithmic acidity constant in the range from 6 to 13.

* * * * *